United States Patent [19]

Elliott

[11] 4,425,728

[45] Jan. 17, 1984

[54] STREET SIGN ADAPTER UNIT AND STREET SIGN ASSEMBLY INCLUDING THE SAME

[76] Inventor: Paul G. Elliott, 117 Railroad Ave., Donaldsonville, La. 70346

[21] Appl. No.: 330,962

[22] Filed: Dec. 15, 1981

[51] Int. Cl.[3] ..... G09F 15/00

[52] U.S. Cl. ..... 40/607

[58] Field of Search ..... 40/606, 607, 10 C; 52/103, 38, 632; 248/219.2, 218.4, 121

[56] References Cited

U.S. PATENT DOCUMENTS

| | | | |
|---|---|---|---|
| 716,098 | 12/1902 | Plumbly | 40/607 |
| 965,566 | 7/1910 | Cooley | 40/607 |
| 1,220,716 | 3/1917 | Beery | 40/607 |
| 1,890,483 | 12/1932 | Wood et al. | 40/607 |
| 2,950,787 | 8/1960 | Walsh | 40/607 |
| 3,138,886 | 6/1964 | Cobb | 40/607 |
| 3,250,032 | 5/1966 | Von Gal et al. | 40/607 |

*Primary Examiner*—Gene Mancene
*Assistant Examiner*—Wenceslao J. Contreras

[57] ABSTRACT

A street sign adaptor unit and a street sign assembly for allowing use of standard V-notch perforate metal fence or highway sign posts to be used with standard sign panels for intersecting streets in which the adaptor unit has a varied cross-section to accommodate attachment to both post and sign panel.

5 Claims, 7 Drawing Figures

STREET SIGN ADAPTER UNIT AND STREET SIGN ASSEMBLY INCLUDING THE SAME

BACKGROUND OF THE INVENTION

This invention relates to a street sign adaptor unit and its use in a street sign assembly which is less expensive and more easily installed than street signs using tubular steel posts and the associated hardware used to fix the street sign to the tubular post.

Street signs are well known and in common use with a variety of designs and attachment hardware. For example, Plumbly U.S. Pat. No. 716,098 teaches a street sign assembly in which two pairs of right angularly disposed sign panels are set in back-to-back relation about the tubular adaptor and have upper, lower and intermediate coupling members holding the pairs of sign panels in fixed relation. The machined or stamped parts, threaded connections and tubular post are items which contribute to the cost of this assembly. Further, Ridenour U.S. Pat. No. 1,139,802 shows an additional method of attachment of sign panels to support posts. Finally, Von Gal, Jr., et al. U.S. Pat. No. 3,250,032 teaches the use of conventional fence and highway sign posts of rolled, extruded or pressed steel, iron or aluminum material having projecting, parallel, coplanar side flanges between which a body of trapezoidal cross-section including side walls which converge into a perforate rear wall which is in parallel relation to the side flanges for anchoring and supporting a rotatably adjustable sign in which the rotation mechanism is attached to the upper and lower post sections by trapezoidally cross-sectioned shank and stud portions. However, such conventional fence or sign posts are not adapted to display signs for intersecting streets, e.g., those having sign panels at approximately right angles to each other.

SUMMARY OF THE INVENTION

According to the present invention, there is provided a street sign adaptor unit for use in the placement of street signs on a perforate metal post of trapezoidal cross-section comprising a lower portion having a trapezoidal cross-section for fitment with the post, the lower portion having means in register with the perforations of the post whereby the unit is attachable to the post and an upper portion having means for attachment of at least one signal panel thereto.

Another embodiment of this invention provides a street sign assembly comprising, in combination, a post having projecting, parallel coplanar side flanges between which there is provided a body of trapezoidal cross-section including side walls converging into a perforate rear wall, said rear wall being in parallel relation to said side flanges; an adaptor unit having a lower portion of a cross-section designed for fitment between the converging side walls of said post and apertures in register with the perforations of said rear wall of said post and an upper portion of a length sufficient for attachment thereto of at least one sign panel; at least one sign panel; and means for securely fastening said adaptor unit and said at least one sign panel to said post.

DESCRIPTION OF THE DRAWINGS

The present invention is further illustrated in the figures of the drawings in which.

DETAILED DESCRIPTION OF PREFERRED EMBODIMENTS

The street sign assembly of the present invention is a unique adaptation of presently available materials and a response to the needs of municipalities and local government to provide existing services at lower cost to the public. Street signs must meet rigorous operational criteria of low cost and maintenance, easy installation, resistance to weather and vandalism and high service life and readability. Strangely enough, these factors can all be met even though at first glance they seem highly incompatible. For example, in making a street sign vandal-resistant, one would first think of rugged, expensive metal materials and difficult to remove hardware. However, in contrast, the use of easily replaceable, cheap materials which are easily attached and removed markedly decreases the "challenge" and "trophy value" of a street sign and, hence, decreases the "thrill" of its acquisition or destruction. The present adaptor unit allows the use of conventional V-notch, holed, fence posts or highway sign posts which are not readily convertible to use at intersecting streets because of their design for one-way attachment. Additionally, such V-notch, holed posts are less expensive and more readily available than tubular iron or steel posts. Further, installation costs are far less than required by the conventional tubular posts. It is therefore surprising that they have not heretofore been employed with the adaptor units of the present novel design or of other designs in street sign applications at intersecting streets.

Figure 1:
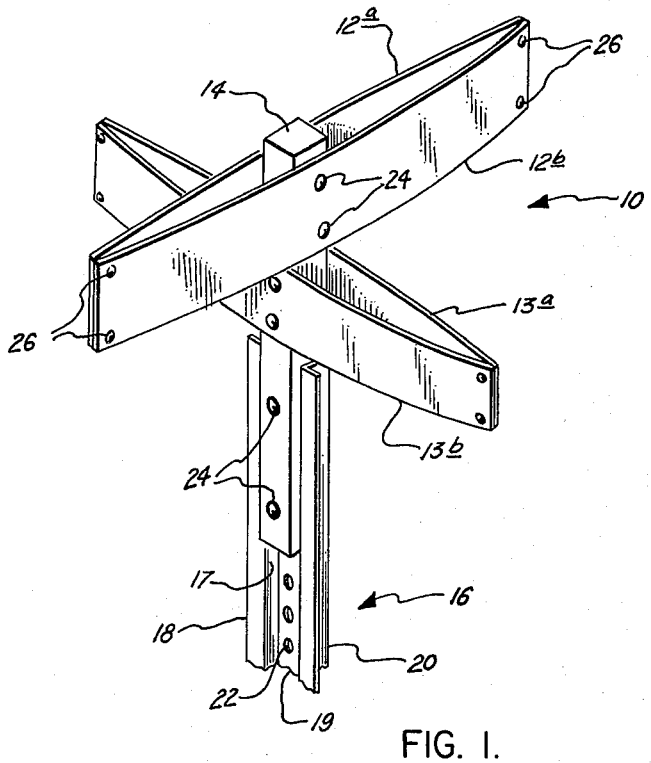
FIG. 1 is a perspective view of the street sign assembly of this invention.
Figure 2:
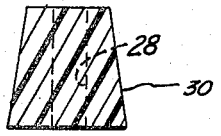
FIGS. 2 and 3 are cross sections of the adaptor unit taken along section lines 2—2 and 3—3, respectively, of FIG. 6.
Figure 3:
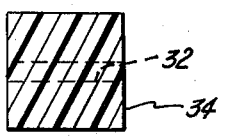
Figure 6:
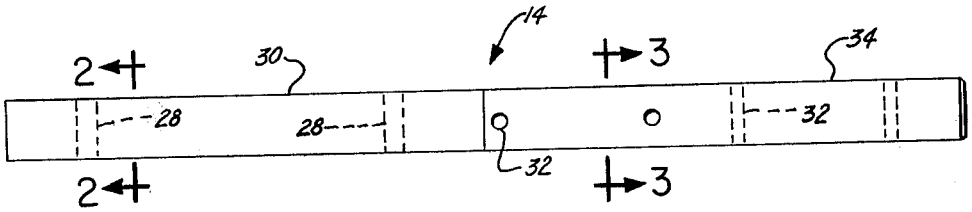
FIGS. 6 and 7 are top and elevational views of the adaptor unit employed in the street sign assembly of FIG. 1.
Figure 7:
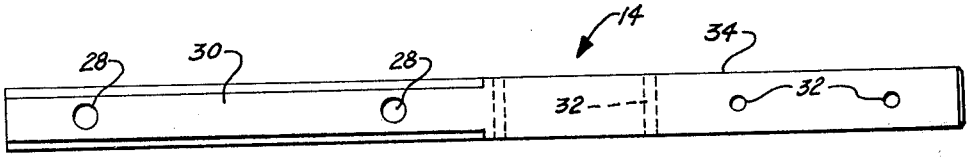

Referring to FIG. 1, the street sign assembly of this invention is generally indicated by the numeral 10 and includes a first pair of sign panels **12*a* and 12*b* and a second pair of sign panels 13*a* and 13*b* disposed in back-to-back relation about an adaptor unit 14 with the first pair of sign panels 12*a* and 12*b* being attached to the adaptor unit 14 at approximately right angles to the second pair of sign panels 13*a* and 13*b* by attaching bolts 24. As shown in FIGS. 6 and 7, adaptor unit 14 has an upper portion 34 which is of square cross section and a lower portion 30 which is of trapezoidal cross section (see FIGS. 2 and 3) for better fit into support post 16 (see FIG. 1). Bolt holes 28 and 32 are provided to accommodate attachment of sign panels 12*a*, 12*b*, 13*a* and 13*b* to the upper portion 34 of adaptor unit 14 and the lower portion 30 of adaptor unit 14 to support post 16**.

The support post 16 is of conventional, rolled, pressed or extruded metal such as iron, steel or aluminum, as is conventional, and includes side flanges 18 attached to a trapezoidal body 19 with side walls 17 converging to perforate rear wall 20 which is in parallel relation with side flanges 18. The rear wall 20 carriers numerous vertically aligned perforations 22.

Figure 4:
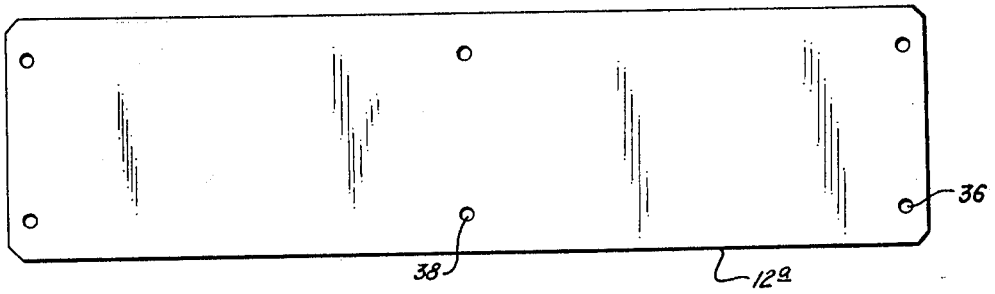
FIGS. 4 and 5 are top and elevational views of the sign panel used in the street sign assembly of FIG. 1.
Figure 5:
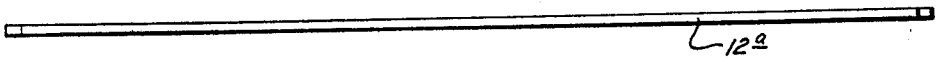

The sign panels **12*a*, 12*b*, 13*a* and 13*b* illustrated in FIG. 1 are identical, but need not be. A more detailed illustration of a preferred sign panel 12*a* is shown in FIGS. 4 and 5 as having a thin rectangular shape with appropriate fastening holes 38 for attachment to the upper section 34 of adaptor unit 14** and fastening holes 36 for holding the ends of sign panels 12*a* and 12*b* or 13*a* and 13*b* together, for example, by rivets 26.

The adaptor unit 14 and sign panels 12*a*, 12*b*, 13*a* and 13*b* can be constructed of metal, wood or plastic materials which are inexpensive, weather-resistant and easily formed. Preferably, the adaptor unit 14 is of wood and the sign panels are of plastic.

Having described the various embodiments of this invention illustratively, those skilled in the art will readily envision various changes and modifications which can be made within the scope and spirit of this invention. Therefore, it is desired that the present invention be limited only by the lawful scope of the following claims.

What is claimed is:

1. A street sign assembly comprising, in combination, a post having projecting, parallel coplanar side flanges between which there is provided a body of trapezoidal cross-section including side walls converging into a perforate rear wall, said rear wall being in parallel relation to said side flanges; an adaptor unit having a lower portion of a cross section designed for fitment between the converging side walls of said post and apertures in register with the perforations of said rear wall of said post and an upper portion of a length sufficient for attachment thereto of at least one sign panel; at least one sign panel; and means for securely fastening said adaptor unit and said at least one sign panel to said post.

2. The assembly of claim 1 in which said means for attachment are nuts and bolts.

3. The assembly of claim 1 further characterized by a first pair of sign panels disposed back-to-back upon opposite sides of the upper portion of said adaptor unit and attached thereto intermediate their ends by said means for attachment, a second pair of sign panels disposed back-to-back upon opposite sides of said adaptor unit; said second pair being at an angle of about 90 degrees with relation to and above said first pair of sign panels, both of said pairs of sign panels having their ends fixedly attached together.

4. The assembly of claim 1 in which the upper portion of said adaptor unit is a square cross section.

5. The assembly of claim 3 in which the upper portion of said adaptor unit is a square cross section.

* * * * *